United States Patent [19]

Van der Woude

[11] Patent Number: 4,875,829

[45] Date of Patent: Oct. 24, 1989

[54] MARINE PROPELLER

[75] Inventor: Gerbrig W. Van der Woude, Rock Island, Ill.

[73] Assignee: Van Der Woude Plastic Corporation, Moline, Ill.

[21] Appl. No.: 239,495

[22] Filed: Aug. 31, 1988

[51] Int. Cl.[4] ..... B63H 1/20

[52] U.S. Cl. ..... 416/2; 416/93 A; 416/241 A

[58] Field of Search ..... 416/93 A, 93 M, 244 B, 416/245 A, 241 A, 230 R, 2

[56] References Cited

U.S. PATENT DOCUMENTS

| | | | |
|---|---|---|---|
| 2,616,511 | 11/1952 | Perrott | 416/93 A |
| 3,092,185 | 6/1963 | Alexander | 416/93 A |
| 3,246,698 | 4/1966 | Kiekhaefer | 416/93 A |
| 3,865,509 | 2/1975 | Frazzell et al. | 416/93 A |
| 4,331,429 | 5/1982 | Koepsel et al. | 416/93 A |
| 4,388,070 | 6/1983 | Kasschau | 416/93 A |
| 4,477,228 | 10/1984 | Duffy et al. | 416/244 B X |
| 4,511,339 | 4/1985 | Kasschau | 416/93 A X |
| 4,667,758 | 6/1987 | Dennis | 416/93 A |

FOREIGN PATENT DOCUMENTS

| | | | |
|---|---|---|---|
| 1093619 | 5/1984 | U.S.S.R. | 416/93 A |

*Primary Examiner*—Everette A. Powell, Jr.
*Attorney, Agent, or Firm*—Henderson & Sturm

[57] ABSTRACT

A marine propeller possessing several features; e.g., one-piece cast or molded construction which in one embodiment preferably of the invention is a plastic of the class including polyester; an improved center or core structure in the form of a nave or barrel having an annular wall concentrically surrounding a power-shaft-receiving hub joined to the annular wall by relatively thin spokes configured as vanes functioning as an interior turbine. Propeller blades are joined to and project radially from the exterior of the nave in typical fashion.

2 Claims, 2 Drawing Sheets

MARINE PROPELLER

BACKGROUND AND SUMMARY OF THE INVENTION

Known marine propellers, especially those designed for use with power sources, such as internal-combustion engines of relatively high horsepower, are mainly metallic or, if of non-metallic material, utilize metallic inserts for increased strength, principally in the form of a metallic hub having splines to receive the driving shaft. Moreover, prior propellers, in order to further achieve the requisite strength, have thick heavy spokes between the hub and the surrounding barrel, which reduces the open area for the passage and evacuation of engine exhaust gases. The use of metallic hubs elevates the load level at which the hub or shaft splines will shear in response to overloads, often resulting in extreme and costly damage to the power transmission. Still, further, prior propellers have been costly and complicated to manufacture.

According to the present invention, the foregoing disadvantages and drawbacks are eliminated and a significantly improved, high-strength, lower-cost and markedly more efficient product is provided, featuring such improvements as one-piece construction, of strong, light-weight material, which in one embodiment is non-metallic material of the class including polyester; a barrel or nave structure configured as an interior screw for facilitating the discharge or evacuation of exhaust gases from the driving engine; and the provision of a hub having internal key means designed to shear in response to overloads on the propeller of a predetrmined value below the level at which the power transmission would be damaged. Other aspects of the invention reside in materially lower cost of manufacture, long life and more efficient operation.

Further features will become apparent as preferred embodiments of the invention are disclosed herein.

DETAILED DESCRIPTION OF PREFERRED EMBODIMENTS OF THE INVENTION

Figure 1:
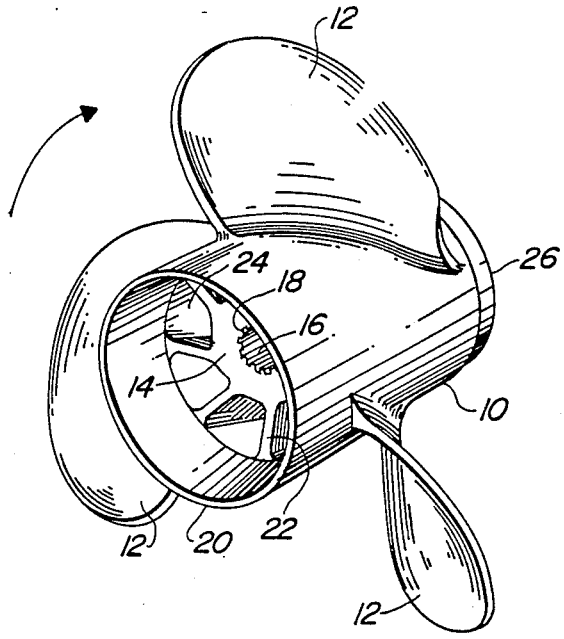
FIG. 1 is a perspective of the improved propeller.
Figure 2:
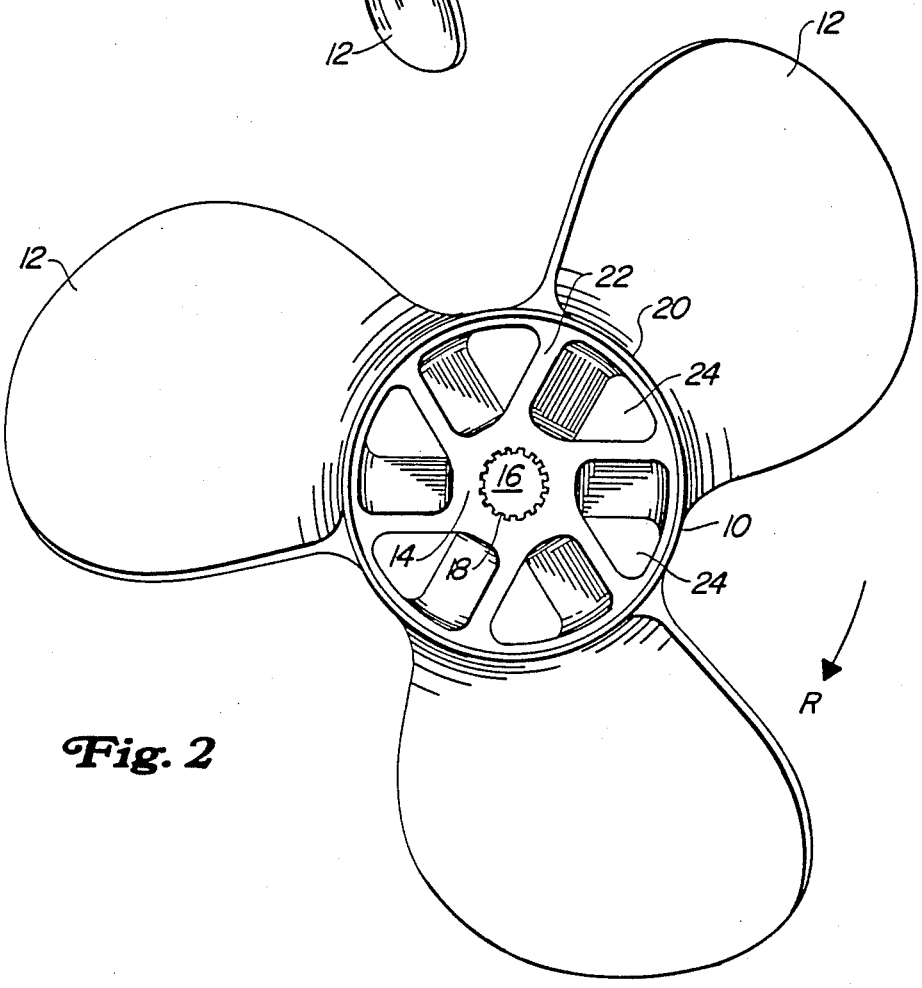
FIG. 2 is a rear view, on an enlarged scale, of the propeller.
Figure 3:
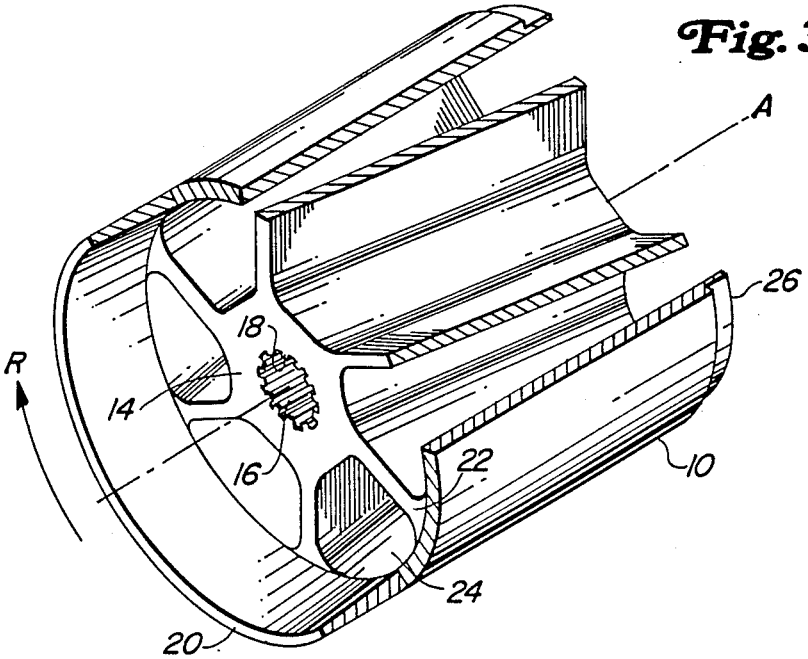
FIG. 3 is a perspective, with portions broken away to reveal the interior structure of the nave or barrel, the propeller blades having been omitted in the interests of clarity.

FIGS. 1 and 2 best show the improved propeller as comprising a central structure in the form of a nave or barrel (10) from which propeller blades (12) radiate in typical fashion and within which is a concentric hub (14) having a central opening (16) for receiving a driving shaft (not shown) which may be typically driven from a power source such as an internal-combustion engine (also not shown). The shaft opening (16) is provided with key means, here splines (18), for affixation of the propeller to the power shaft. The nave or barrel has an annular wall (20) which concentrically spacedly surrounds the hub and the hub and nave are rigidly interjoined by a plurality of spokes or blades (22) extending from the exterior of the hub to the interior surface of the annular wall (20).

Figure 4:
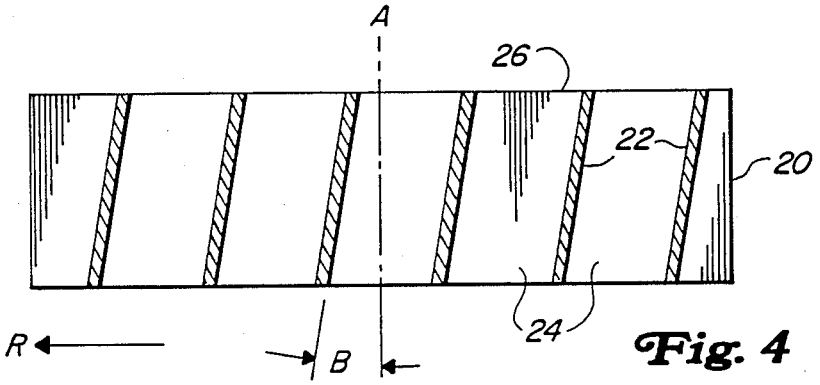
FIG. 4 is a "developed" view of the turbine vanes.
Figure 5:
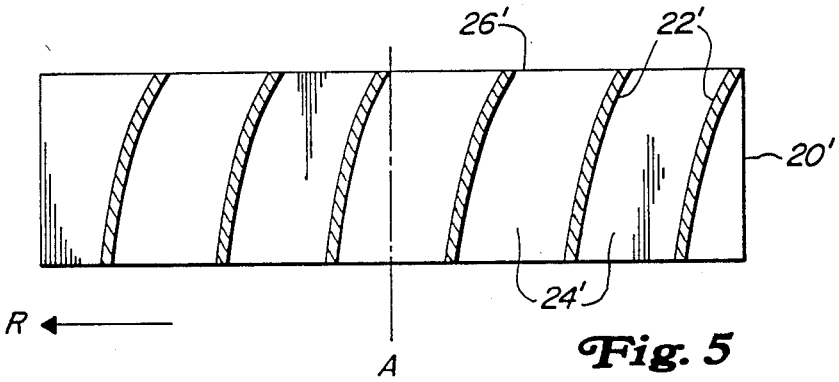
FIG. 5 is a similar view showing a modified form of vane structure.

Because of the use of high-tensile-strength material, adequate strength and rigidity are achieved in central structure including the nave, hub and spokes, and, as a result, the annular wall (20) may be of reduced thickness and the spokes may be relatively thin in angular dimension as compared to the prior art, yielding, as a result, a larger open area within the nave by the provision of larger passages or openings (24), all of which facilitates the discharge of engine exhaust gases rearwardly through the nave, consequently minimizing back pressure on the engine. To further enhance the ability of the interior nave and spoke structure to function as a turbine for expelling exhaust gases, each spoke is in the form of a vane configured, as seen in FIG. 4, as straight but inclined to a plane passed through and including the axis of rotation A of the propeller. The angle of inclination is shown at B in FIG. 4. The resulting turbine action serves to pump the exhaust gases to the rear and out the open rear end of the propeller as indicated by the numeral (26). In the modified form of turbine as seen in FIG. 5, the spokes or vanes (24') are curved and are contained within the nave wall (20') in the manner referred to in the description of FIG. 4, leaving passages (24'). In FIG. 5, the numeral (26') indicates the rear of the propeller.

As a further characteristic of the turbine, the vanes are non-radical to the hub; that is to say, as best seen in FIG. 2, each vane has its outer or have proximate portion offset angularly in the direction of rotation of the propeller and its base or hub-proximate portion offset angularly in the opposite direction. As a matter of symmetry, the spokes are equi-angularly spaced apart about the axis A of the propeller. Stated otherwise, the spokes or vanes, viewed edge-wise, are generally tangential to a concentric circle (not shown) included in the hub.

The material chosen for the one-piece construction should have such characteristics as high tensile strength and ready adaption to molding or casting processes. As respects that phase of the invention residing in the use of non-metallic or plastic material, good results are obtained from injection molding of a plastic of the class including polyester, one example of which that known as "Rynite", a product of duPont. Particularly with regard to the use of this type of material, the integral splines (18) have more than adequate strength to handle the torque between the driving shaft and the propeller but are capable of shearing in response to overloads on the propeller, thus protecting the power transmission of which the shaft is a part. Normally, failure to shear at the proper time causes serious damage to the transmission, at a cost far in excess of the cost of a new propeller. The design is especially adapted for use with engines of fifteen horsepower and up. The example disclosed here is about fourteen inches O.D.

Features and advantages of the invention other than those set forth herein will readily occur to those versed in the art, as will many modifications of the preferred embodiments disclosed, all without departure from the spirit and scope of the invention.

I claim:

1. A marine propeller drivable by a power source including an internal combustion engine and a drive shaft, the propeller being of unitary, one-piece molded construction of light-weight, rigid, high-strength, non-metallic material having a unitary central structure in the form of a nave centered on the axis of rotation of the propeller and including an integral, coaxial hub, an integral annular wall concentrically and spacedly surrounding the hub and a plurality of qui-angularly spaced apart spokes extending between and integral with the hub and the interior surface of the annular wall and providing a like plurality of fore-and-aft engine-exhaust passages, the hub having an axially central opening for axis-wise mounting or dismounting from the shaft and including shaft-engaging splines integral with the hub and configured and dimensioned to shear in response to overloads on the propeller of a predetermined value below the load level at which the power source would be damaged, and a plurality of propeller blades integral with and radiating from the outer surface of the annular wall.

2. A marine propeller according to claim 1, in which the spokes are relatively thin in angular dimension and the passages are correspondingly relatively large whereby in increase the open area in the nave so as to expedite the discharge of engine exhaust gases through the nave.

* * * * *